United States Patent [19]

Ruger et al.

[11] 4,449,312

[45] May 22, 1984

[54] MECHANISM ADAPTABLE FOR SINGLE ACTION REVOLVERS

[75] Inventors: William B. Ruger, Southport; Roy L. Melcher, Stratford, both of Conn.

[73] Assignee: Sturm, Ruger & Company, Inc., Southport, Conn.

[21] Appl. No.: 313,215

[22] Filed: Oct. 20, 1981

[51] Int. Cl.[3] ..... F41C 17/04; F41C 17/08; F41C 1/00

[52] U.S. Cl. ..... 42/66

[58] Field of Search ..... 42/65, 66, 70 E, 70 F

[56] References Cited

U.S. PATENT DOCUMENTS 3,157,958 11/1964 Lewis ..... 42/66 X 3,777,384 12/1973 Ruger et al. ..... 42/66

4,218,839 8/1980 Brouthers ..... 42/65

4,316,341 2/1982 Landry ..... 42/70 F

*Primary Examiner*—Donald G. Kelly

*Attorney, Agent, or Firm*—Pennie & Edmonds

[57] ABSTRACT

A single action firearm having a hammer with a load and a full-cock position, a trigger and a frame with a reciprocating firing pin positioned in the frame above the trigger in which a trigger bar is nested in both side and front recesses in the hammer. The recesses are located in the exterior of the hammer to permit a larger hammer to be removed from a firearm and the recessed hammer and trigger bar of this invention substituted. The trigger bar as installed is positioned below the trigger in the load position and behind the firing pin in the full-cock position.

6 Claims, 7 Drawing Figures

FIG. 6
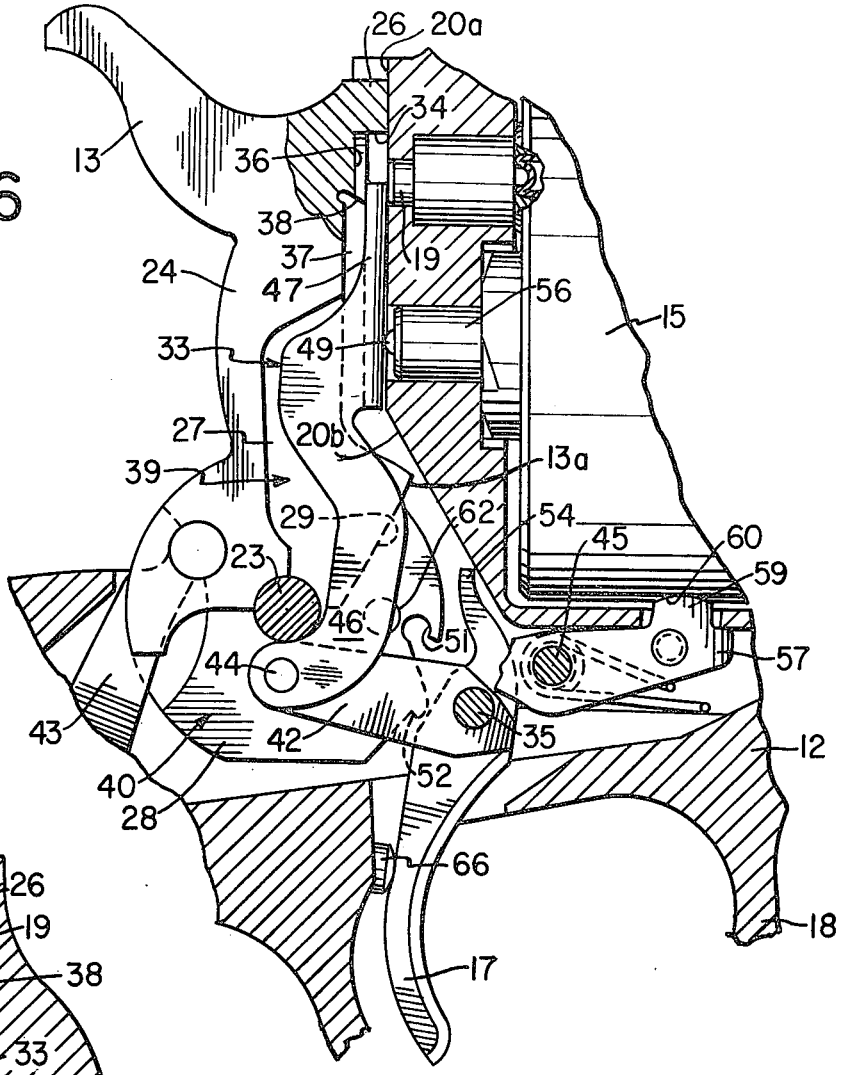
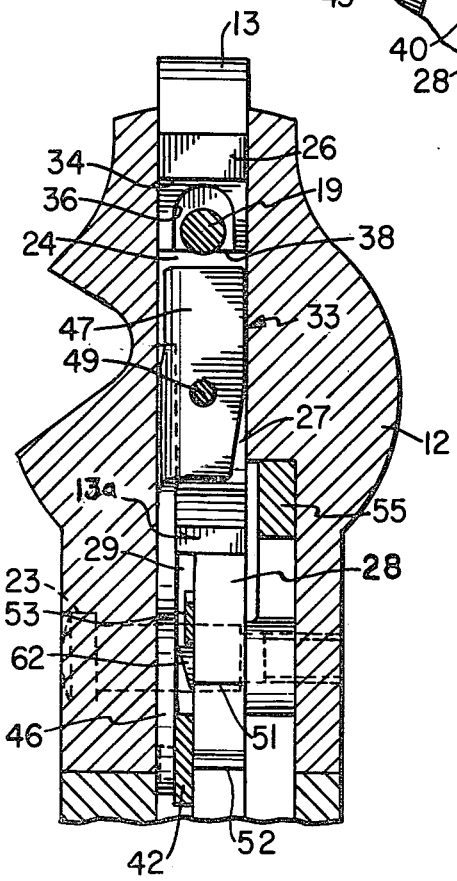
FIG. 7

MECHANISM ADAPTABLE FOR SINGLE ACTION REVOLVERS

BACKGROUND OF THE INVENTION

1. Field of Invention

This invention relates to revolvers and other firearms and, in particular, to an improved hammer and trigger bar design to avoid under certain conditions unintended discharge of the firearms due to careless or improper handling.

2. Prior Art

Numerous arrangements have been proposed for preventing under certain conditions unintended discharge of firearms due to careless or improper handling. To avoid direct contact of the hammer and firing pin while the firearm is being carried, loaded, or under other conditions where discharge is not intended, many mechanisms and designs have been proposed over the years. For example, pivotable trigger bars have been suggested and used as shown in the present assignee's U.S. Pat. No. 3,777,384 issued to Ruger et al in 1973 and slidable transfer bars have been shown in U.S. Pat. No. 3,157,958 to Lewis issued November 1964 and German Pat. No. 1,917,716 dated October 1970.

Another technique for avoiding, under certain conditions of operation, the transmission of force from the hammer to the firing pin is disclosed in U.S. Pat. No. 624,321 issued to Fyrberg in 1899 in which a firing pin assembly is pivotably mounted to avoid being struck by the hammer in selected positions.

These prior patents provide a background of development of the art from before 1900 through Ruger's contribution as patented in 1973. However, the mechanisms described above were designed to be incorporated into new firearm designs and it has therefore been hitherto considered impossible to incorporate the trigger bar or transfer bar mechanism into existing single action revolvers due to available space restrictions.

SUMMARY OF THE INVENTION

Broadly, the present invention comprises a uniquely shaped and sized hammer having a plurality of front and side recesses and projections for accommodating and controlling a trigger bar pivoted about a trigger extension. The trigger bar is, as urged and guided by the hammer, the hammer pivot and a cylinder pivot pin plunger, moved to a variety of positions as the hammer is moved to its rest, load, full-cock and fired positions.

The location of the trigger bar at various hammer positions determines whether the revolver is capable of being discharged should the hammer move from its then position to its down position, the trigger bar being interposed between the hammer and the firing pin only when the trigger is restrained in its rearmost position.

A projection on the forward portion of the hammer is adjacent the trigger bar when the hammer is in its loading position which hammer projection serves to trap the trigger bar against the rear surfaces of the revolver frame so as to prevent upward movement of the trigger bar if a blow is struck to the hammer in its loading position.

The unique mechanism of the present invention is intended to be placed in existing single action revolvers but can be used in other firearms having external hammers adoptable to this mechanism. The above described hammer recesses permit fitting this invention into existing firearms without alteration to the frame of the firearm.

BRIEF DESCRIPTION OF THE DRAWINGS

FIG. 6 is an enlarged partial sectional view showing the revolver in the fired position; and FIG. 7 is a sectional view taken along lines 7—7 of FIG. 2.

DESCRIPTION OF A PREFERRED EMBODIMENT

Figure 1:
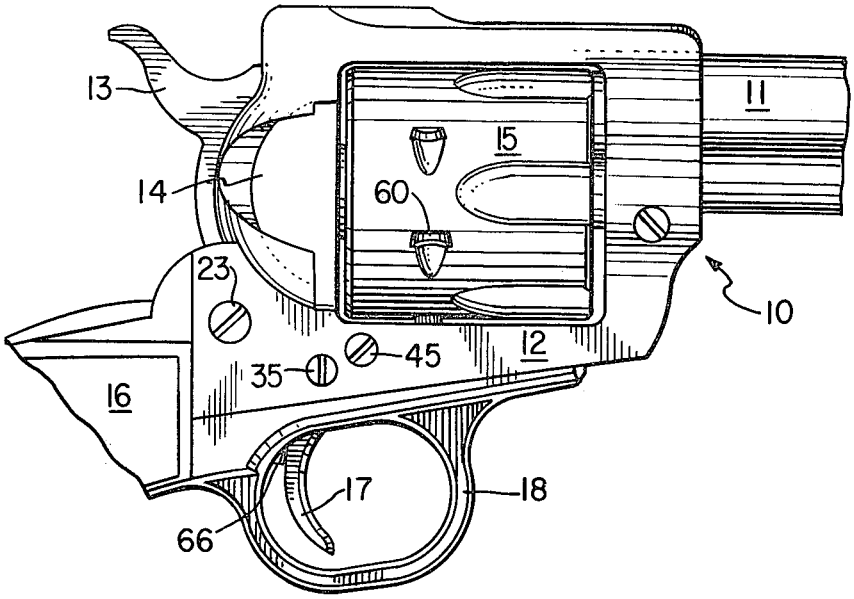
FIG. 1 is a partial right hand side elevational view of a revolver having the mechanism of the invention.

Referring to FIG. 1, a revolver 10 is shown having a barrel 11, frame 12, hammer 13 pivoted about hammer pivot 23, loading gate 14, cylinder 15, grip 16, trigger 17 rotatable about pivot 35 and trigger guard 18.

Figure 2:
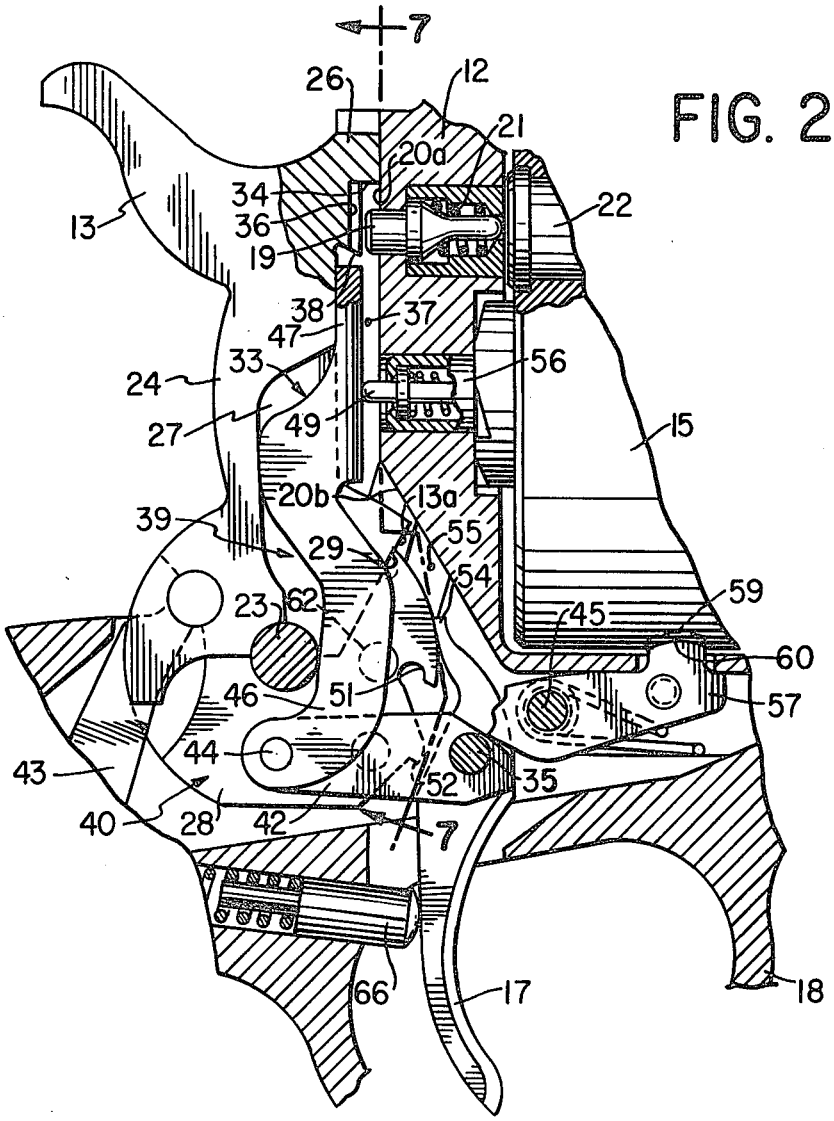
FIG. 2 is an enlarged partial sectional view showing the revolver with its hammer in its rest position.
Figure 5:
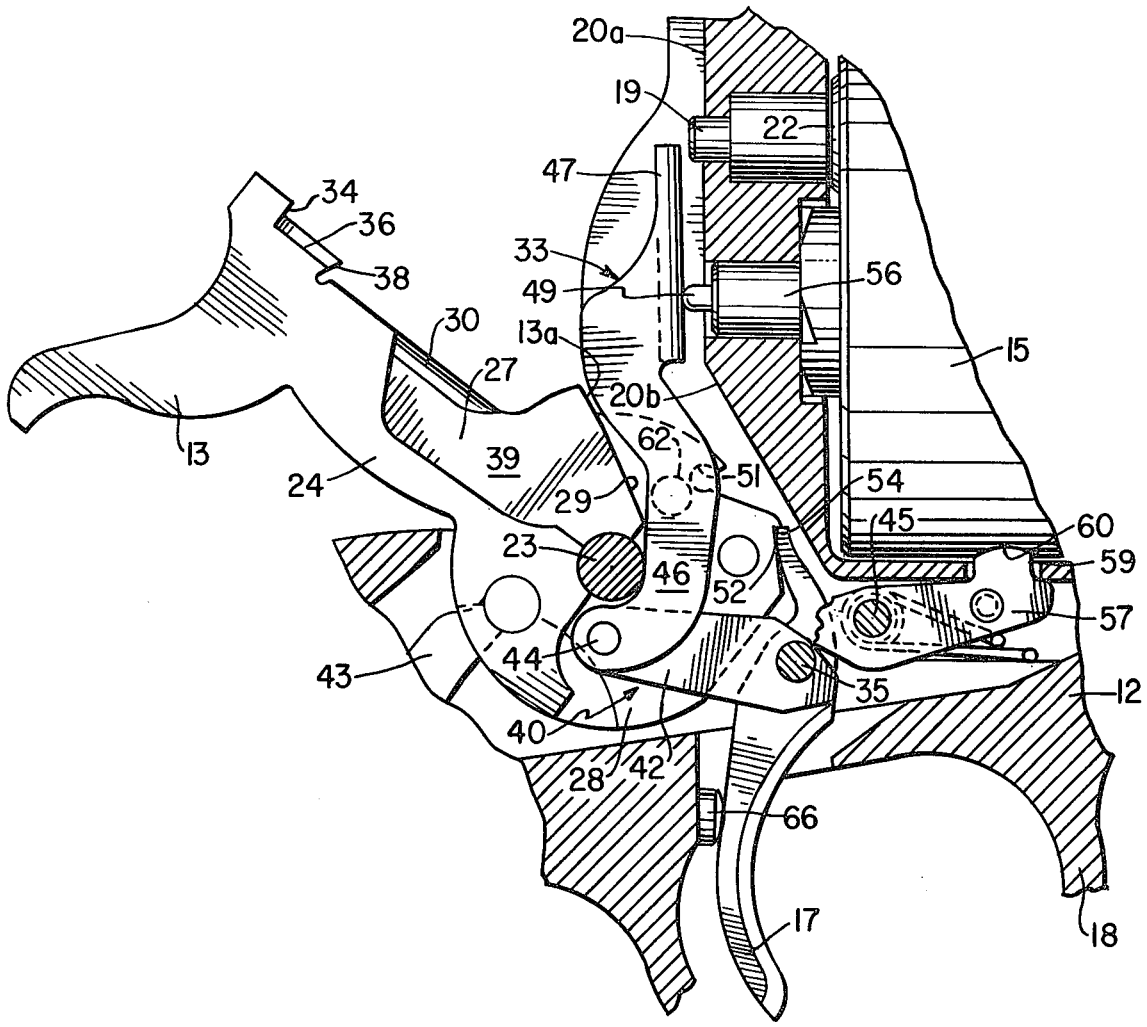
FIG. 5 is an enlarged partial sectional view showing the revolver in its full-cocked position.

Turning to the details of construction of FIG. 2, firing pin 19, urged rearwardly by coil spring 21, is mounted to strike cartridge 22 in cylinder 15. Hammer 13, pivotable about hammer pivot 23, is composed of three integrally formed portions (1) a full-width stout portion 24 including a nose piece 26 which rests on frame 12 in the hammer rest position, (2) an intermediate reduced-width recess-forming portion 27 and (3) a lower reduced-width recess-forming portion 28 (see also FIG. 7). Lower hammer portion 28 and the thinner intermediate hammer portion 27 are separated by a divider step 29 demarking the difference in thicknesses of the two hammer portions (see also FIG. 7). The width of intermediate hammer portion 27 includes rounded front face 30 as shown in FIGS. 5 and 7. Hammer stout portion 24 may have any suitable width to fit a particular design; however, where hammer 13 is to be used as a conversion part for an existing revolver full-width hammer portion 24 must have a width to be accommodated in the converted revolver. In such a conversion, the maximum width of the hammer should be equal to or less than the width of the hammer to be substituted.

The size and shape of hammer 13 (including upper portion 24, hammer nose 26 and intermediate and lower portions 27 and 28) provides a plurality of recesses to accommodate firing pin 19, trigger bar 33, trigger bar plunger 49 and trigger arm extension 42 at various stages in the operation of the revolver as herein shown and explained. In particular, firing pin recess 34 in front of hammer 13 is formed by the spacing between upper frame face **20*a* of frame 12 and the hammer stout portion 24. Upper front recess 34 is further defined by frame 12, hammer nose piece 26 and arched hammer element 36 positioned immediately below nose piece 26. Below recess 34 is a lower front recess 37 bounded by hammer stout portion 24, frame 12 and having its upper limit partially determined by angled hammer notch 38. Trigger bar 33 is partially accommodated in front recess 37 during the rest position of hammer 13** as shown in FIG. 2.

With further reference to FIG. 2, hammer strut 43 engages hammer 13 to urge the hammer to its down position. Trigger bar 33, which rotates about pivot 44, includes lower trigger bar section 46 and an upper trigger bar section 47 positioned substantially at right angles to the lower section 46 (see also FIG. 7). Trigger bar 33 is urged rearwardly by spring-loaded trigger bar plunger 49 mounted on cylinder pivot pin 56 bearing against upper bar section 47. Hammer 13 has both a loading notch 51 and a full-cock notch 52. Trigger sear 54 and cylinder pawl 55 are also shown. Trigger arm extension 42 is fixed to trigger 17 to, at all times, move with the trigger.

Figure 3:
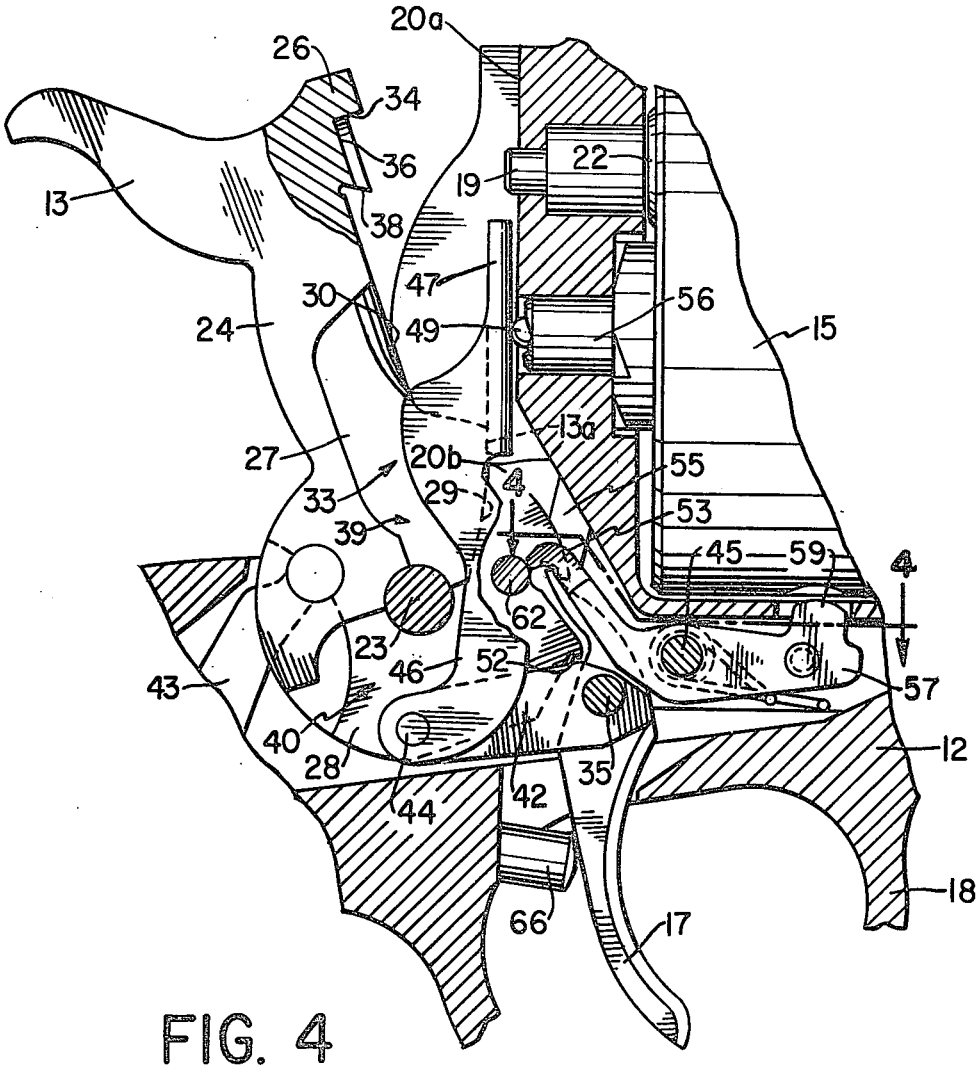
FIG. 3 is an enlarged partial sectional view showing the revolver in the loading position.
Figure 4:
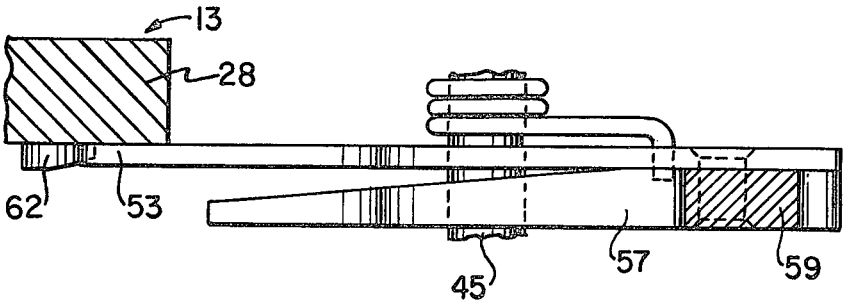
FIG. 4 is a sectional view taken along lines 4—4 of FIG. 3.

The reduce-width portions 27 and 28 of the hammer provide both upper and lower side recesses 39 and 40, respectively, for accommodating the trigger bar 33, the trigger arm extension 42 and the cylinder latch deflector finger 53 (see FIG. 3).

Turning to FIGS. 2, 3, 5 and 6 and operation of the revolver, it is seen that with hammer 13 down in the rest position, firing pin 19 is protected in firing pin recess 34 avoiding transmission of force to the firing pin through the hammer. With the hammer at rest, trigger bar 33 may be moved slightly upwardly by pulling trigger 17 to overcome trigger return plunger 66; however, as trigger bar 33 is raised with trigger pull, the upper end of bar 33 will strike hammer notch 38 and be arrested. Thus, if the trigger is pulled while handling the revolver in the hammer rest position, trigger bar 33 cannot move into recess 34.

Looking now at FIG. 3, the load (unloaded) position of the revolver has been reached by pulling back hammer 13 until trigger sear 54 sets in loading notch 51 causing cylinder latch finger 53 to ride up on hammer cam 62 thus rotating cylinder latch arm 57 about pivot 45 to move detent 59 out of engagement with the cylinder notch 60. Cylinder 15 is then freely rotatable for loading or unloading. In this position, the trigger bar 33 is moved to a lower position than it held in the hammer rest position of FIG. 1 since the trigger arm 42 has rotated partially counterclockwise. Trigger bar 33 has also moved relative to the hammer within side recesses 39, 40 as the hammer was pulled back to the load position.

The position of trigger bar 33 in the load position is determined by hammer projection **13*a* which limits the backward movement of bar 33 against the rearward urging of trigger bar plunger 49. Lower section 46 of bar 33 is positioned in side recess 39 and side recess 40 while upper trigger bar section 47 (including the surface that is at right angle to plunger 49) remains below firing pin 19. With trigger bar 33 positioned as shown in FIG. 3, sufficient movement of the trigger sear 54 relative to the loading notch 51 to release the hammer 13 for movement by strut 43 to the hammer-down position would not discharge the revolver because trigger bar 33 movement would not be such that it would intercede between the hammer 13 and the firing pin 19**.

In the load position hammer projection **13*a* is in close proximity to trigger bar 33. In the event of a heavy blow to the hammer 13 in the load position, projection 13*a* will trap trigger bar 33 against rear surfaces 20*a* and 20*b* of revolver frame 12. If the blow is of sufficient magnitude, projection 13*a* will force trigger bar 33 to deform, move forward and bend so that trigger bar 33 will generally conform to surfaces of frame 12. This deformation of trigger bar 33 will prevent vertical motion of trigger bar 33 and thus prevent the bar interposing between hammer 13 and firing pin 19**.

In the full-cock position of FIG. 5, the hammer 13 has been cocked until the full-cock notch 52 is engaged with the trigger sear 54. In this position the cylinder latch arm 57 has moved, carrying its detent 59, into engagement with the cylinder 15 to lock the cylinder against rotation. Trigger bar 33 has moved forward due to the action of hammer pivot 23 on the back surface of lower bar section 46. In the ready-to-fire position, the trigger bar 33 including its upper section 47 is positioned behind the firing pin 19.

Finally, in the fired position of FIG. 6, trigger bar 33 has been moved forward by the force of the descending hammer 13 against firing pin 19 to discharge the revolver.

A revolver, not including a trigger bar, such as certain single action revolvers, may be converted to a revolver including a trigger bar and the advantages, as herein disclosed, thereby attained by removing from such revolver: the hammer, the trigger, the cylinder latch, the cylinder pawl and the cylinder pivot pin and substituting the following parts herein described (1) the notched and recessed hammer (2) the trigger with fixed extension (3) the configured trigger bar (4) the cylinder pawl (5) the cylinder pivot pin carrying the transfer bar plunger and (6) the cylinder latch including its spring. This conversion is exemplary of similar conversions that may be made on other revolvers using the mechanism of this invention.

We claim:

1. In a firearm having a hammer, a trigger and a frame which hammer is rotated rearwardly manually by the operator to a cocked position without trigger pull by the operator and having a reciprocating firing pin positioned above the trigger in the frame to be struck in a forward direction by the hammer, the improvement comprising (a) a trigger bar mounted on the trigger;

(b) trigger bar biasing means biasing the trigger bar rearwardly;

(c) the hammer having a front facing the frame and two sides substantially perpendicular to such front, the hammer being sized and shaped to include full-cock and loading notches and a plurality of front and side recesses, said recesses being defined by the exterior size and shape of the hammer front and sides and said exterior side recesses providing space for the trigger bar to rest in and to move into and out of as the trigger, hammer, and biasing means position the bar in rest, load, full-cock and fired positions; and (d) a hammer projection on the front of the hammer in close proximity to the trigger bar in the load position whereby the trigger bar is positioned substantially below the firing pin in the load position and is deformable if the hammer is dealt a substantial forward blow to move the hammer toward the frame and the trigger bar is positioned as high as and behind the firing pin in the full-cock position.

2. The firearm of claim 1 in which the trigger bar has a lower portion substantially accommodated by side recesses in the hammer and an upper portion that is accommodated by the front recesses in the hammer.

3. The firearm of claim 1 having pivotable cylinder latch means including detent means for engagement with cylinder, cam means on the hammer and finger means cooperating with such cam means so that as the cam means moves the finger means the detent means are in turn moved to release the cylinder.

4. The firearm of claim 1 having a trigger arm extension positioned along side the trigger bar in the lower side hammer recess.

5. The firearm of claim 1 in which the hammer includes a projection for engaging and deforming the trigger bar when the hammer is forced toward the frame from its load position.

6. In a firearm having a hammer, a trigger and a frame, the hammer adapted to be manually cocked rearwardly to move the trigger and hammer to a full-cock position and a reciprocating firing pin position above the trigger to be struck as the hammer moves forwardly, the improvement comprising (a) the hammer having a front facing the frame and two sides substantially perpendicular to the front, the hammer being sized and shaped to include loading and full-cock notches and an exterior side hammer recess;

(b) a hammer pivot extending into the side recess;

(c) a trigger arm extension secured to the trigger also extending into said side recess;

(d) a trigger bar plunger projecting rearwardly from the frame toward the hammer;

(e) a trigger bar mounted on the trigger extension for resting in and movement in said side recess as the trigger, hammer, hammer pivot and the bar plunger move to positions of rest, load, full-cock and fired; said trigger bar having a lower section for movement in the side recess and an upper section positionable at all times in front of the hammer; and (f) a hammer projection on the front of the hammer in close proximity to the trigger bar in the load position the hammer and trigger bar during operation being positioned such that (1) in the at rest hammer down position, the upper section of the trigger bar is in front of the hammer but substantially below the firing pin with the hammer spaced from the firing pin (2) in the load position with the hammer cocked, the bar is moved in the side recess further below the firing pin and said bar is deformable if the hammer receives a substantial blow moving the hammer forward toward the frame (3) with the hammer and trigger in the full-cock position the bar is moved upwardly and to the rear of the firing pin and (4) at the fired position the trigger bar is positioned behind the firing pin having effected discharge of the revolver.

* * * * *